US008421328B2

(12) United States Patent
De Santiago et al.

(10) Patent No.: US 8,421,328 B2
(45) Date of Patent: Apr. 16, 2013

(54) INFRARED HEAT LAMP HAVING VERTICAL BURNING POSITION

(75) Inventors: Arturo De Santiago, El Paso, TX (US); Andres Rodriguez, Chih (MX)

(73) Assignee: OSRAM SYLVANIA Inc., Danvers, MA (US)

( * ) Notice: Subject to any disclaimer, the term of this patent is extended or adjusted under 35 U.S.C. 154(b) by 151 days.

(21) Appl. No.: 13/193,126

(22) Filed: Jul. 28, 2011

(65) Prior Publication Data

US 2013/0026904 A1 Jan. 31, 2013

(51) Int. Cl.
*H01K 1/18* (2006.01)
*H01K 1/24* (2006.01)
*H01K 7/00* (2006.01)

(52) U.S. Cl.
USPC ..... 313/315; 313/271; 313/274; 313/578

(58) Field of Classification Search ..... 313/315, 313/316, 271–279, 579–580, 285
See application file for complete search history.

(56) References Cited

U.S. PATENT DOCUMENTS 4,499,398 A * 2/1985 Munroe ..... 313/113

FOREIGN PATENT DOCUMENTS

| | | | | |
|---|---|---|---|---|
| JP | 02079359 | A | * | 3/1990 |
| JP | 05217562 | A | * | 8/1993 |
| JP | 2005268266 | A | * | 9/2005 |
| JP | 2007234566 | A | * | 9/2007 |
| KR | 2004076403 | A | * | 9/2004 |
| KR | 2007087452 | A | * | 8/2007 |

* cited by examiner

*Primary Examiner* — Mariceli Santiago
(74) *Attorney, Agent, or Firm* — Edward S. Podszus

(57) ABSTRACT

An infrared heat lamp (200) having a vertical burning position includes an outer tubular member (202) and a heating element (208) having a coiled portion (214) at least partially disposed within the outer tubular member (202). The heating element (208) includes first and second terminal ends (210, 212), wherein the coiled portion (214) is defined therebetween, the coiled portion (214) having a plurality of turns (216) defining a through passage (218). The heat lamp (200) further includes an inner elongate member (222) disposed within the through passage (218) of the coiled portion (214), the inner elongate member (222) having a plurality of support members (224) extending therefrom. Each of the plurality of support members (224) engages at least one of the plurality of turns (216) of the coiled portion (214), whereby the coiled portion (214) is supported by the plurality of support members (224) when the heating element (208) is in a vertical orientation.

15 Claims, 6 Drawing Sheets

INFRARED HEAT LAMP HAVING VERTICAL BURNING POSITION

FIELD

The present disclosure relates generally to an infrared heat lamp, and, more particularly, to an infrared heat lamp configured operate in a vertical burning position.

BACKGROUND

Infrared heater systems may include infrared heat lamp(s) configured to emit infrared radiation, which, in turn, may be used as a deliberate heating source. For example, an infrared heater system may be used to cook and/or heat food and may also be used in industrial manufacturing processes, including, but not limited to curing of coatings, forming of plastics, annealing, plastic welding, and print drying. Additionally, an infrared heater system may be used to heat a surrounding environment, such as one's home or office.

ACKNOWLEDGED PRIOR ART

FIG. 1 is an exploded view of a prior art infrared heat lamp, such as one available in the United States from Osram Sylvania Inc. under the designation "J168" rated 500 W 115V and used in portable heaters marketed by EdenPURE®. The infrared heat lamp 100 includes an outer tubular member 102 and a coiled heating element 104 disposed within the outer tubular member 102. The coiled heating element 104 includes a first terminal end 106 and a second terminal end 108. The coiled heating element 104 is wound about an inner tubular member 110, wherein at least a portion of the second terminal end 108 is disposed within the inner member 110 and insulated from other portions of the heat element 104. The outer tubular member 102 is formed from high-temperature resistant and/or insulating material(s), such as quartz tube, ceramic tube, or ceramic enamel tube. The coiled heating element 104 and the inner tubular member 110 are disposed within the outer tubular member 102, whereby the outer tubular member 102 serves as an insulator for the coiled heating element 104. A first end of the outer tubular member 102 is sealed with a first end cap 112 and a second opposing end of the outer tubular member 102 is sealed with a second end cap 114.

When in operation, an electric current passes through the coiled heating element 104 via the first and second terminal ends 106, 108, thereby heating and causing the heating element 104 to emit infrared radiation. The infrared heat lamp 100 may be used as a heating source in a heater system, whereby the heater system may direct the infrared radiation emitted from the heat lamp 100 to a desired application. In many applications, it may be desirable for a user to have the ability to set an infrared heater system in a variety of positions. For example, in regard to a heater system for heating one's home, rather than having the heater system rest on the floor, a user may wish to secure the system on a wall or ceiling, which may save floor space. Additionally, the user may wish to position the heater system at a particular orientation. However, known heat lamps, such as the infrared heat lamp 100 described above, suffer the disadvantage of coil sagging and thus are limited to operation in horizontal or non-vertical orientations, thus restricting positioning options of a heater system incorporating known heat lamps. In particular, heating elements, such as the coiled heating element 104 described above, may not safely operate in a vertical orientation, and, instead, may be limited to a horizontal burning position.

For example, when current is passed through the coiled heating element 104, the filament material of the heating element 104 may reach high temperatures. Due to the high temperatures, individual coils of the heating element 104 may soften and droop. When in a horizontal position, the outer tubular member 102 can serve as a support means for the coiled heating element 104, supporting the sagging coils. However, if in a vertical position, the sagging of the individual coils may lead to contact between one or more of the coils. This can eventually cause a short circuit in the heating element, which leads to higher currents passing through the heating element with an associated increase in heating element temperature. This increase in temperature further accelerates the coil sagging and causes a further compression of the turns of the coil, ultimately leading to damage of the heat lamp.

BRIEF DESCRIPTION OF THE DRAWINGS

Features and advantages of the claimed subject matter will be apparent from the following detailed description of embodiments consistent therewith, which description should be considered with reference to the accompanying drawings, wherein:

DETAILED DESCRIPTION

In general, this disclosure provides an infrared heat lamp configured to operate in a vertical burning position, as well as a horizontal burning position. The infrared heat lamp includes a coiled heating element disposed within an outer tubular member. The infrared heat lamp further includes an inner elongate member disposed within the coiled heating element, the inner elongate member having a plurality of support members extending therefrom and configured to engage and support the coiled heating element when the heat element is in a vertical orientation. An infrared heat lamp consistent with the present disclosure may be used in a compatible heater system and allows a user to position the heater system in a variety of desired orientations. In particular, an infrared heat lamp consistent with the present disclosure is configured to operate in a variety of burning positions, including, but not limited to, vertical and horizontal burning positions.

Figure 1:
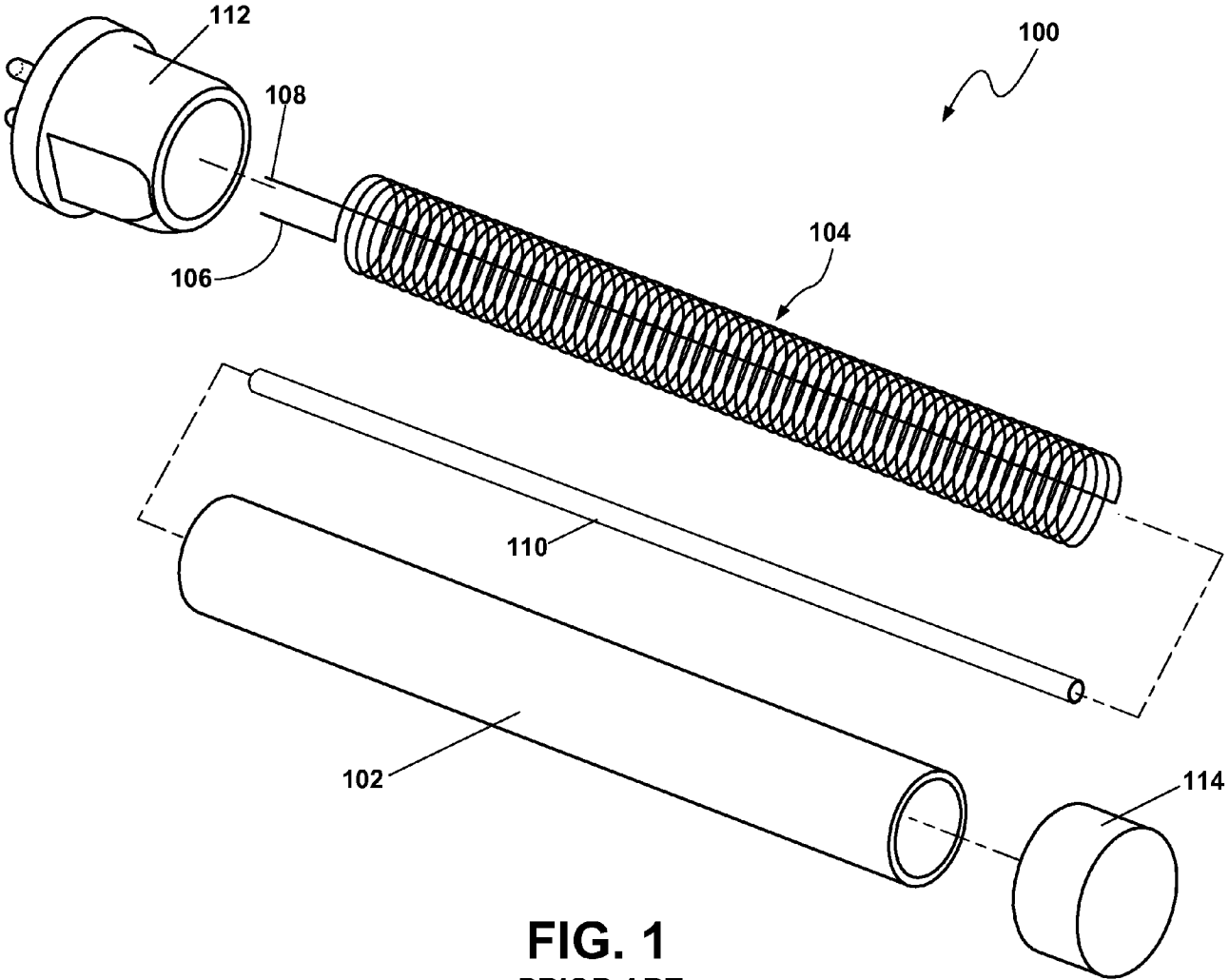
FIG. 1 PRIOR ART
FIG. 1 is an exploded view of a prior art infrared heat lamp.
Figure 2:
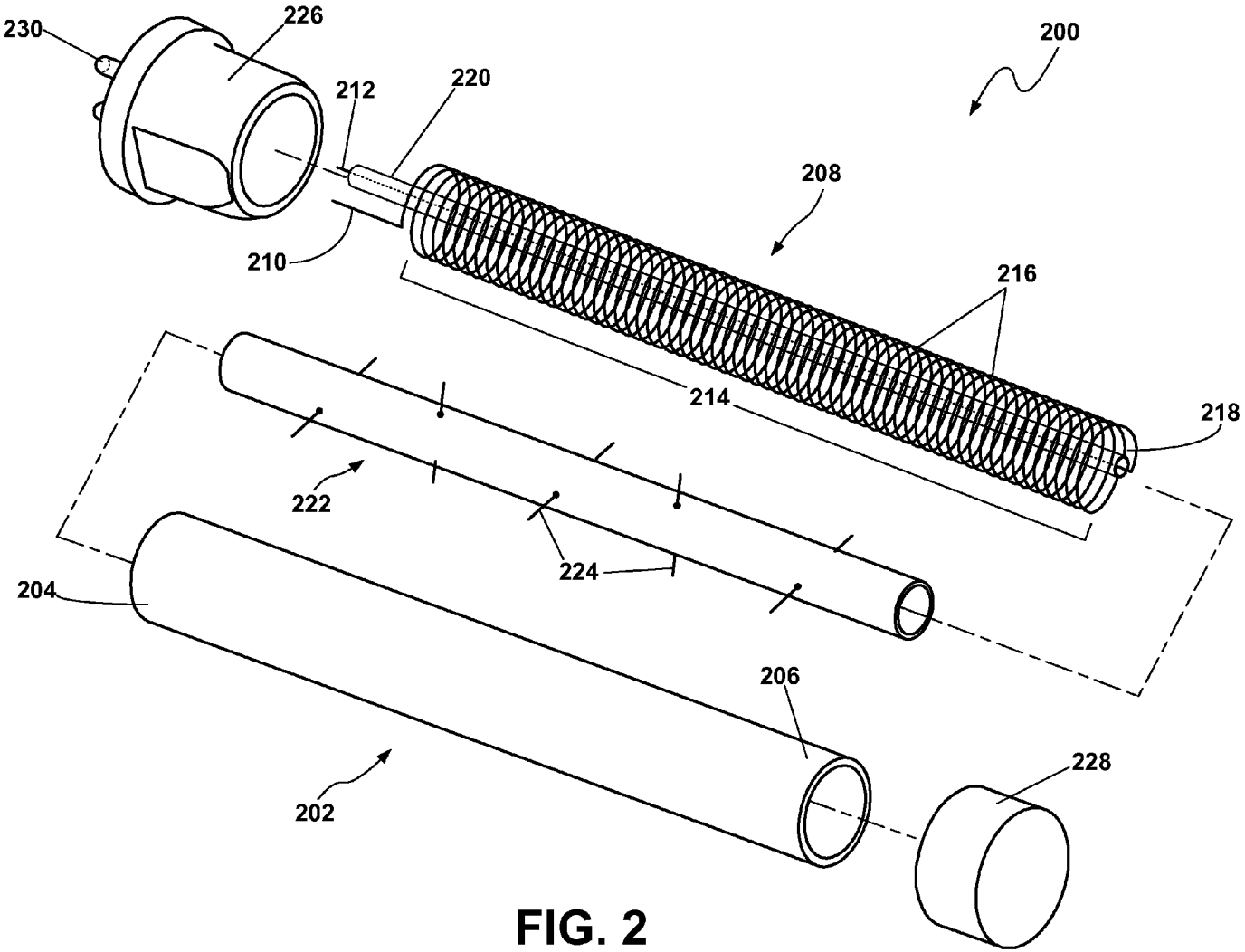
FIG. 2 is an exploded view of an infrared heat lamp consistent with the present disclosure.
Figure 3:
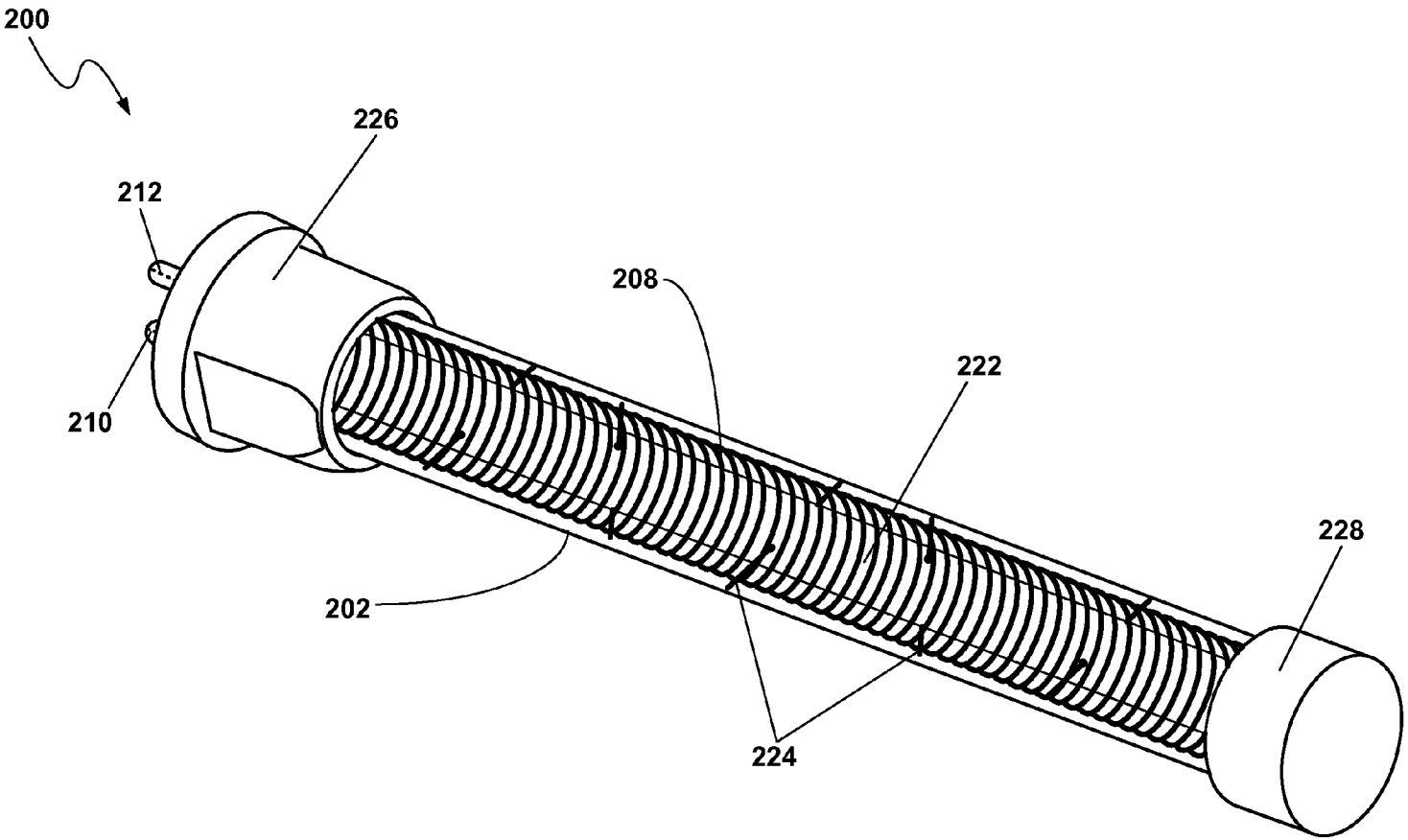
FIG. 3 is a perspective view of the infrared heat lamp of FIG. 2 showing the heat lamp in an assembled state.

FIG. 2 is an exploded view of an infrared heat lamp consistent with the present disclosure. FIG. 3 is a perspective view of the infrared heat lamp of FIG. 2 showing the heat lamp in an assembled state. Generally, the infrared heat lamp 200 includes an outer tubular member 202 and a heating element 208 having a coiled portion 214 disposed within the outer tubular member 202. The infrared heat lamp 200 further includes an inner elongate member 222 disposed within at least the coiled portion 214 of the heating element 208. The inner elongate member 222 supports the coil portion 214 of the heating element 208 when the heating element 208 is in a vertical orientation, thereby allowing the heat lamp 200 to operate in a vertical burning position.

As shown, the heating element 208 includes a first terminal end 210 and a second terminal end 212, wherein at least a portion of the second terminal end 212 is disposed within an inner tubular member 220 and insulated from other portions of the heating element 208. The coiled portion 214 is defined between the first 210 and second 212 terminal ends. The coiled portion 214 includes a plurality of turns 216 defining a through passage 218, wherein the inner tubular member 220 is disposed within the through passage 218. During operation, an electric current passes through the heating element 208 via the first 210 and second 212 terminal ends, thereby heating and causing the heating element 208, specifically the coiled portion 214, to emit infrared radiation. The heating element 208 includes a single continuous wire, wherein the wire is a flexible, resilient, and durable material configured to be bent and/or shaped into a desired dimension, such as the plurality of turns 216. The heating element 208 includes electrically conductive filament material(s) configured to withstand high temperatures and/or heat, including, but not limited to, tungsten, carbon, alloys of iron, chromium and aluminum, and/or combinations thereof.

As shown, the inner elongate member 222 is disposed within the through passage 218 of the coiled portion 214 of the heating element 208. The inner elongate member 222 includes a plurality of support members 224 extending from a surface of the inner elongate member 222, wherein each of the plurality of support members 224 engages at least one of the plurality of turns 216 of the coiled portion 214. When in a vertical orientation (shown in FIG. 5), each of the plurality of support members 224 is configured to support at least a portion of the coiled portion 214 of the heating element 208.

The heat lamp 200 further includes a first end cap 226 and a second end cap 228 coupled to a first end 204 and a second end 206, respectively, of the outer tubular member 202. The first and second end caps 226, 228 include openings through which the first and second terminal ends 210, 212 of the heating element 208 extend. For example, as shown, the first end cap 226 includes an opening 230 through which the second terminal end 212 extends. When fully assembled, as shown in FIG. 3, the first and second end caps 226, 228 are sealed to the outer tubular member 202, thereby enclosing the heating element 208, inner tubular member 220, and inner elongate member 222 within the outer tubular member 202.

The outer tubular member 202 includes a material configured to withstand high temperatures and/or heat and may be transmissive to infrared radiation. In one embodiment, the outer tubular member 202 includes a heat-resistant quartz (fused silica) glass material. Similarly, the inner elongate member 222 includes a material configured to withstand high temperatures and/or heat and may be transmissive to infrared radiation. The inner elongate member 222 includes a heat-resistant quartz (fused silica) glass material.

Figure 4:
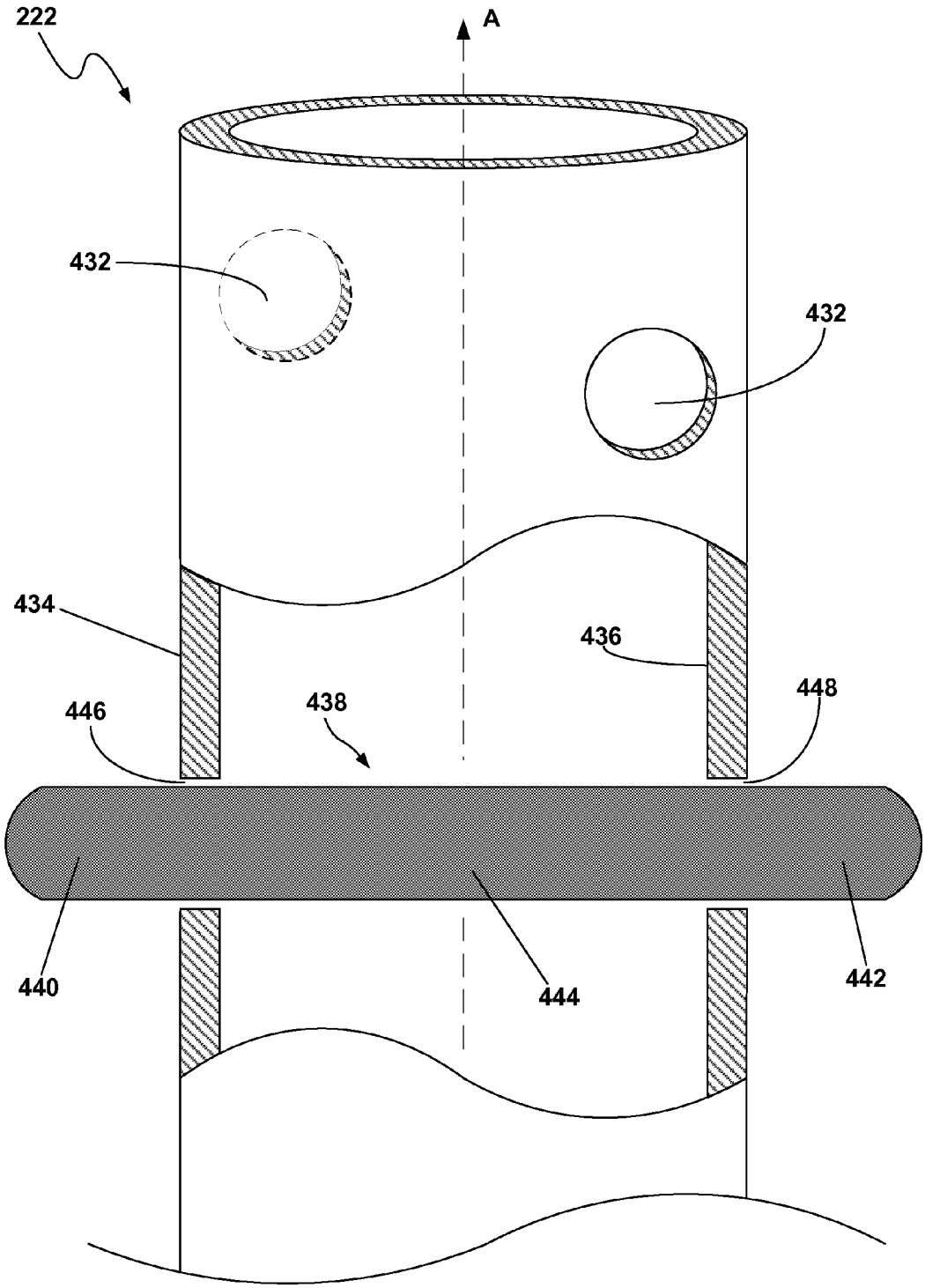
FIG. 4 is an enlarged partial side view of the inner elongate member of FIG. 3.

FIG. 4 is an enlarged partial side view of the inner elongate member of FIG. 3. In the illustrated embodiment, the inner elongate member 222 is hollow and includes an exterior surface 434 and an interior surface 436. A plurality of apertures 432 are formed along a length of the inner elongate member 222. Each of the plurality of apertures 432 is shaped and/or sized to receive and/or retain an associated one of the plurality of support members 224. As generally understood by one of ordinary skill in the art, the plurality of apertures 432 may be formed by a variety of methods. In the illustrated embodiment, the plurality of apertures 432 are formed by a drilling method. As shown, each of the plurality of apertures 432 extends from an exterior surface 434 to an interior surface 436 of the inner elongate member 222. A pair of apertures, for example a first aperture 446 and a second aperture 448, are positioned on opposing sides of the inner elongate member 222, such that the first and second apertures 446, 448 oppose one another.

As shown, one 438 of the plurality of support members 222 (hereinafter referred to as "support member 438" for purposes of clarity and consistency) passes substantially transversely through the hollow inner elongate member 222. More specifically, the support member 438 passes through the hollow elongate member 222 via the pair of apertures 446, 448. The support member 438 includes first and second ends 440, 442 and a central portion 444 formed therebetween. The first and second ends 440, 442 extend outwardly from the first and second apertures 446, 448, respectively and the central portion 444 is positioned within the hollow inner elongate member 222 between the first and second apertures 446, 448. As shown, when received and retained by the pair of apertures 446, 448, the support member 438 is substantially perpendicular to a longitudinal axis A of the inner elongate member 222. The pair of apertures 446, 448 are sized and/or shaped to allow the support member 438 to sit loosely within. In other embodiments, the pair of apertures 446, 448 may be sized and/or shaped to allow a press fit with the support member 438. Additionally, the support member 448 may be fixed by other means generally understood by one of ordinary skill in the art.

It should be noted that in other embodiments, the plurality of support members 224 may not pass entirely through the hollow inner elongate member 222. Instead, each of the plurality of support member 224 may be received and retained in an associated one of the plurality of apertures 432, wherein a support member may have one end extending outwardly from the inner elongate member 222 and an opposing end fixed within the aperture. The opposing end of the support member may be fixed a variety of means generally understood by one of ordinary skill in the art, such as press-fit. In a yet further embodiment, the support members 224 may be formed integrally with the inner elongate member 222, such as being molded of quartz, it being then understood that apertures 432 would not be needed.

Figure 5:
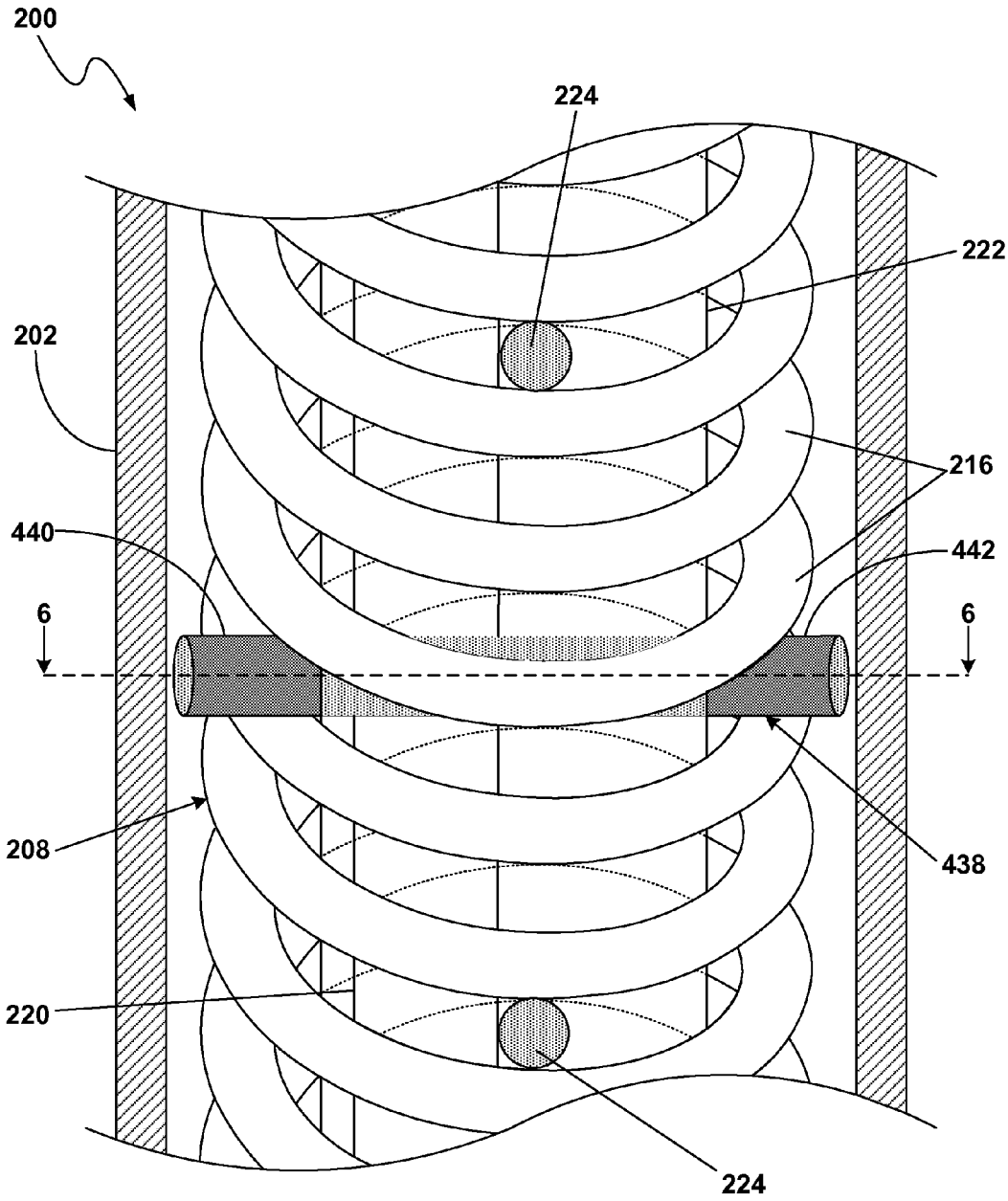
FIG. 5 is an enlarged partial side view of the infrared heat lamp of FIG. 3 showing the lamp in a vertical burning position.
Figure 6:
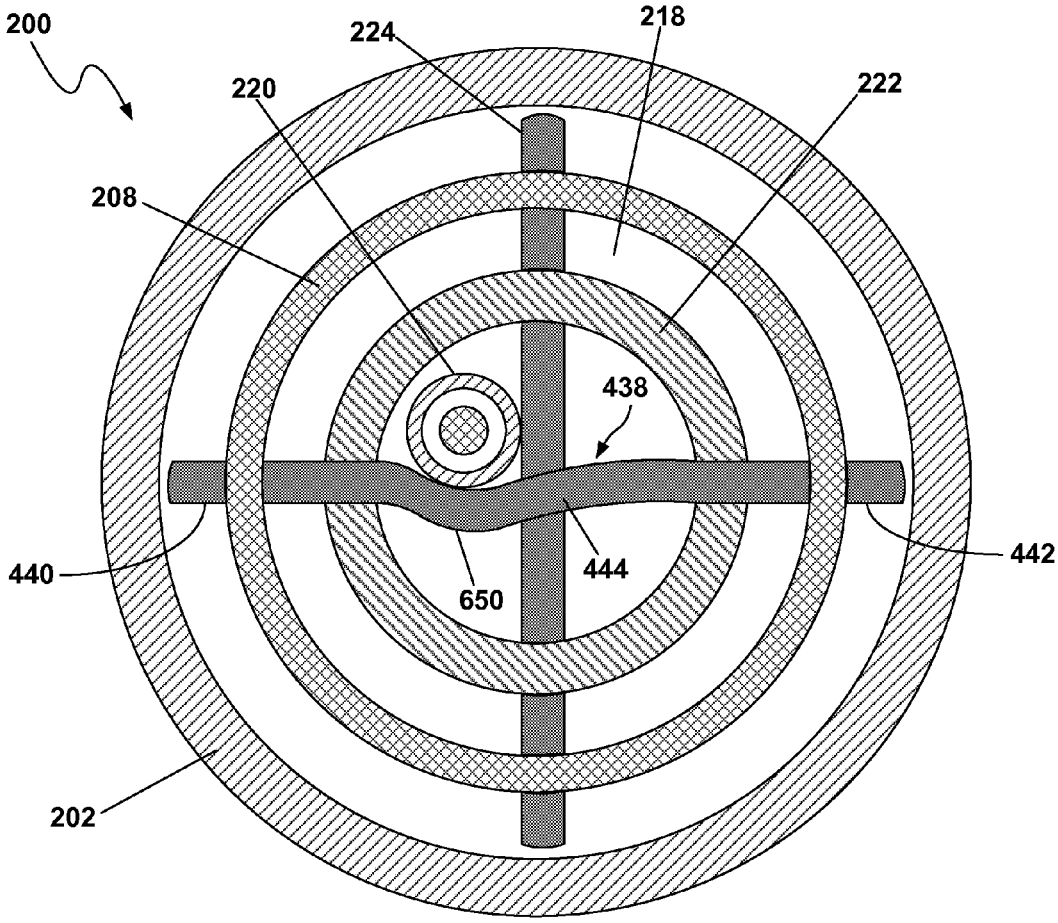
FIG. 6 is a sectional view taken along line 6-6 of FIG. 5.

FIG. 5 is an enlarged partial side view of the infrared heat lamp of FIG. 3 showing the lamp in a vertical burning position. FIG. 6 is a sectional view taken along line 6-6 of FIG. 5. In the illustrated embodiment, the plurality of support members 224, including support member 438, engage and support the coiled portion 214 of the heating element 208 when the heating element 208 is in a vertical position. More specifically, the first and second ends 440, 442 of the support member 438 engage and support portion(s) of at least one of the plurality of turns 216 of the coiled portion 214.

As previously described, the heat lamp 200 may include an inner tubular member 220 within which one of the terminal ends of the heating element 208 is disposed and insulated. In the illustrated embodiment, the inner tubular member 220 is disposed within the inner elongate member 222 when the heat lamp 200 is fully assembled. Referring to FIG. 6, at least one of the plurality of support members 224 is shaped and/or sized to accommodate for the inclusion of the inner tubular member 220 within the inner elongate member 222. As shown, the central portion 444 of the support member 438 has an arcuate configuration 650, thereby allowing the central portion 444 to pass around the inner tubular member 220 disposed within the hollow inner elongate member 222. It should be noted that the support member 438 may have a variety of configurations, not just limited to arcuate, to allow at least the central portion 444 to pass around the inner tubular member 220.

The plurality of support members 224 are formed from a flexible, resilient, and durable material configured to be bent and/or shaped into a desired dimension. The plurality of support members 224 are made of a material that withstands high temperatures and/or heat and retains shape and/or rigidity under high temperatures and/or heat. In one embodiment, the plurality of support members may include an iron-chromium-aluminium (FeCrAl) alloy, the same material of which the coiled portion 214 is made.

An infrared heat lamp 200 consistent with the present disclosure is configured to allow the heating element 208 of the heat lamp 200 to operate, not only in the standard horizontal burning position, but in a vertical burning position. For example, the plurality of support members 224 of the inner elongate member 222 are configured to engage and support portions of the coiled portion 214 of the heating element 208 when in a vertical orientation, thereby preventing sagging portions (due to high temperatures during operation) of the coiled portion 214 from contact with one another and ultimately preventing short circuiting and excess temperatures. Additionally, an infrared heat lamp 200 consistent with the present disclosure may be used as a heating source in a heater system, whereby the heater system may direct the infrared radiation emitted from the heat lamp 200 to a desired application. The heat lamp 200 allows a user to position the heater system in a variety of desired orientations, including a vertical position.

Consistent with one embodiment of the present disclosure, an infrared heat lamp 200 includes an outer tubular member 202 and a heating element 208 having a coiled portion 214 at least partially disposed within the outer tubular member 202. The heating element 208 includes first and second terminal ends 210, 212, wherein the coiled portion 214 is defined therebetween, the coiled portion 214 having a plurality of turns 216 defining a through passage 218. The heat lamp 200 further includes an inner elongate member 222 disposed within the through passage 218 of the coiled portion 214, the inner elongate member 222 having a plurality of support members 224 extending therefrom. Each of the plurality of support members 224 engages at least one of the plurality of turns 216 of the coiled portion 214, whereby the coiled portion 214 is supported by the plurality of support members 224 when the heating element 208 is in a vertical orientation.

While several embodiments of the present disclosure have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present disclosure is/are used. Those skilled in the art will recognize, or be able to ascertain using no more than routine experimentation, many equivalents to the specific embodiments of the disclosure described herein. It is, therefore, to be understood that the foregoing embodiments are presented by way of example only and that, within the scope of the appended claims and equivalents thereto, the disclosure may be practiced otherwise than as specifically described and claimed. The present disclosure is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

The following is a non-limiting list of reference numerals used in the specification:

100 prior art infrared heat lamp
102 outer tubular member
104 heating element
106 first terminal end of heating element
108 second terminal end of heating element
110 inner tubular member
112 first end cap
114 second end cap
200 infrared heat lamp
202 outer tubular member
204 first end of outer tubular member
206 second end of outer tubular member
208 heating element
210 first terminal end of heating element
212 second terminal end of heating element
214 coiled portion of heating element
216 plurality turns of coiled portion
218 through passage of coiled portion
220 inner tubular member
222 inner elongate member
224 plurality of support members
226 first end cap
228 second end cap
230 opening in the first end cap
432 plurality of apertures on inner elongate member
434 exterior surface of inner elongate member
436 interior surface of inner elongate member
438 one of said plurality of support members
440 first end of support member
442 second end of support member
444 central portion of support member
446 first aperture of said plurality of apertures
448 second aperture of said plurality of apertures
650 arcuate dimension of central portion of support member
A longitudinal axis of the inner elongate member

What is claimed is:

1. A heat lamp (200) comprising:

an outer tubular member (202);

a heating element (208) having first and second terminal ends (210, 212) and a coiled portion (214) defined between said first and second terminal ends (210, 212), said coiled portion (214) being disposed at least partially within said outer tubular member (202), said coiled portion (214) having a plurality of turns (216) defining a through passage (218); and an inner elongate member (222) disposed within said through passage (218) of said coiled portion (214), said inner elongate member (222) having a plurality of support members (224) extending therefrom, each of said plurality of support members (224) engaging at least one of said plurality of turns (216) of said coiled portion (214);

whereby said coiled portion (214) is supported by said plurality of support members (224) when said heating element (208) is in a vertical orientation.

2. The heat lamp of claim 1, wherein a plurality of apertures (432) are defined along a length of said inner elongate member (222).

3. The heat lamp of claim 2, wherein at least one of said plurality of apertures (432) is configured to receive and retain one (438) of said plurality of support members (224).

4. The heat lamp of claim 3, wherein said inner elongate member (222) is hollow and each of said plurality of apertures (432) extends from an exterior surface (434) of said inner elongate member (222) to an interior surface (436) of said inner elongate member (222).

5. The heat lamp of claim 4, wherein said one (438) of said plurality of support members (224) passes substantially transversely through said hollow inner elongate member (222), said one (438) of said plurality of support members (224) having first and second ends (440, 442) and a central portion (444) formed therebetween, said first end (440) extending outwardly from a first one (446) of said plurality of apertures (432), said second end (442) extending outwardly from a second one (448) of said plurality of apertures (432), and said central portion (444) being positioned within said hollow inner elongate member (222) between said first and second ones (446, 448) of said plurality of apertures (432).

6. The heat of lamp of claim 5, wherein said first and second ones (446, 448) of said plurality of apertures (432) are positioned substantially opposing one another, such that said one (438) of said plurality of support members (224) is substantially perpendicular to a longitudinal axis (A) of said inner elongate member (222).

7. The heat lamp of claim 5, wherein both said first and second ends (440, 442) of said one (438) of said plurality of support members (224) engage and support a portion of at least one of said plurality of turns (216) of said coiled portion (214).

8. The heat lamp of claim 7, wherein one of said first and second terminal ends (210, 212) of said heating element (208) is disposed within an inner tubular member (220), said inner tubular member (220) being disposed within said hollow inner elongate member (222).

9. The heat lamp of claim 8, wherein said central portion (444) of said one (438) of said plurality of support members (224) has an arcuate configuration (650) thereby allowing said central portion (444) to pass around said inner tubular member (220) within said inner elongate member (222).

10. The heat lamp of claim 1, wherein one of said plurality of support members (224) comprises an iron-chromium-aluminium (FeCrAl) alloy.

11. The heat lamp of claim 1, wherein said inner elongate member (222) comprises a quartz material.

12. The heat lamp of claim 1, wherein said heating element (208) comprises an electrical resistance filament configured to emit infrared radiation when electric current is coupled to and passed through one of said first and second terminal ends (210, 212).

13. The heat lamp of claim 12, wherein said outer tubular member (202) is transmissive to infrared radiation.

14. The heat lamp of claim 1, further comprising first and second end caps (226, 228) coupled to first and second ends (204, 206) of said outer tubular member (202), respectively.

15. The heat lamp of claim 14, wherein at least one of said first and second end caps (226, 228) has an opening (230) through which at least one of said first and second terminal ends (210, 212) extends.

* * * * *